US010408157B2

(12) United States Patent
Umeda

(10) Patent No.: US 10,408,157 B2
(45) Date of Patent: Sep. 10, 2019

(54) DATA-ACQUISITION-INSTRUCTION GENERATING METHOD, DATA-ACQUISITION-INSTRUCTION GENERATING DEVICE, AND COMPUTER-READABLE RECORDING MEDIUM

(71) Applicant: FUJITSU LIMITED, Kawasaki-shi, Kanagawa (JP)

(72) Inventor: Yuhei Umeda, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 104 days.

(21) Appl. No.: 15/453,059

(22) Filed: Mar. 8, 2017

(65) Prior Publication Data

US 2017/0260924 A1 Sep. 14, 2017

(30) Foreign Application Priority Data

Mar. 9, 2016 (JP) ..... 2016-046255

(51) Int. Cl.
*F02D 41/24* (2006.01)
*F02D 41/26* (2006.01)
*F02D 41/14* (2006.01)

(52) U.S. Cl.
CPC ..... *F02D 41/263* (2013.01); *F02D 41/1401* (2013.01); *F02D 41/2419* (2013.01);
(Continued)

(58) Field of Classification Search
CPC ..... F02D 41/2419; F02D 41/2425; F02D 41/2432; F02D 41/2445; F02D 41/263; H03M 3/10
See application file for complete search history.

(56) References Cited

U.S. PATENT DOCUMENTS 4,718,272 A * 1/1988 Plapp ..... F02D 41/28 73/114.36
4,986,243 A * 1/1991 Weissler, II ..... F02D 41/18 123/406.65

(Continued)

FOREIGN PATENT DOCUMENTS

JP 2007-71864 3/2007
JP 2008-77376 4/2008
JP 2014-2519 1/2014

*Primary Examiner* — Erick R Solis
(74) *Attorney, Agent, or Firm* — Staas & Halsey LLP

(57) ABSTRACT

A non-transitory computer-readable recording medium stores a data-acquisition-instruction generating program that causes a computer to execute a process including: first generating a plurality of change curves of each of control parameters based on requisite density information, the requisite density information being related to a data measurement density in a data measurement region specified by a combination of a plurality of control parameters, the plurality of control parameters being used by a device subject to the data measurement; and second generating a data acquisition instruction to perform measurement at a plurality of measurement points with respect to the device to be measured in an order in which change of each control parameter becomes change corresponding to the change curves, and new measurement is performed such that only one of the control parameters changes from previous measurement.

6 Claims, 13 Drawing Sheets

(52) U.S. Cl.
CPC ..... *F02D 41/2432* (2013.01); *F02D 41/2445* (2013.01); *F02D 41/2467* (2013.01); *F02D 2041/1433* (2013.01)

(56) References Cited

U.S. PATENT DOCUMENTS

| | | | | |
|---|---|---|---|---|
| 5,216,916 | A * | 6/1993 | Bederna | F02D 41/2419 73/114.13 |
| 5,270,935 | A * | 12/1993 | Dudek | F02D 41/1401 123/480 |
| 5,815,418 | A * | 9/1998 | Dolazza | H04N 1/401 250/362 |
| 6,744,389 | B2 * | 6/2004 | Haeberli | G01F 15/046 341/118 |
| 7,490,511 | B2 * | 2/2009 | Mayer | G01F 1/6845 73/204.15 |
| 8,824,023 | B2 * | 9/2014 | Kaempflein | H04N 1/04 358/450 |
| 2007/0035556 | A1 | 2/2007 | Hasegawa | |
| 2013/0339371 | A1 | 12/2013 | Hayashi et al. | |

* cited by examiner

| TIME | 1 | 2 | 3 | 4 | 5 | 6 |
|---|---|---|---|---|---|---|
| MEASUREMENT CONDITION | U(1) | U(2) | U(3) | U(4) | U(5) | U(6) |
| MEASUREMENT DATA | X(1) | X(2) | X(3) | X(4) | X(5) | X(6) |

| | | | | | | |
|---|---|---|---|---|---|---|
| MEASUREMENT CONDITION | U(1) | U(2) | U(3) | U(4) | U(5) | U(6) |
| MEASUREMENT DATA | X(4) | X(5) | X(6) | X(7) | X(8) | X(9) |

FIG.14

| MODEL | RMSE | CONTRIBUTION RATE |
|---|---|---|
| 1 | 132.73 | 0.9823 |
| 2 | 125.07 | 0.9843 |
| 3 | 127.54 | 0.9837 |
| 4 | 122.85 | 0.9848 |

DATA-ACQUISITION-INSTRUCTION GENERATING METHOD, DATA-ACQUISITION-INSTRUCTION GENERATING DEVICE, AND COMPUTER-READABLE RECORDING MEDIUM

CROSS-REFERENCE TO RELATED APPLICATION

This application is based upon and claims the benefit of priority of the prior Japanese Patent Application No. 2016-046255, filed on Mar. 9, 2016, the entire contents of which are incorporated herein by reference.

FIELD

The embodiments discussed herein are related to a computer-readable recording medium, a data-acquisition-instruction generating method, and a data-acquisition-instruction generating device.

BACKGROUND

Conventionally, control design has been performed. In the control design, a set value of a control parameter to be used for control of a target device, which is a target of control design, is changed and the state of the target device is measured by waiting until the state of the target device becomes a steady state. In the control design, a model of the target device is generated based on measured measurement data.

However, when measurement is to be performed by waiting until the state of the target device becomes a steady state for each measurement condition, it takes time to collect measurement data. Therefore, a technique of performing quasi-steady measurement has been proposed. In the quasi-steady measurement, the set value of the control parameter is changed at a speed that can be regarded as steady, and time-series data that can be acquired is used as steady-state data.

Patent Document 1: Japanese Laid-open Patent Publication No. 2008-077376

Patent Document 2: Japanese Laid-open Patent Publication No. 2014-002519

The quasi-steady measurement is used when the number of control parameters is one. However, with an increase of the number of devices, a plurality of control parameters may be used for control of a target device. Therefore, when a plurality of control parameters are to be used, generation of a model of the target device by the quasi-steady measurement is difficult. Therefore, it can be considered to use, for example, a Hilbert curve, to perform the quasi-steady measurement by sequentially changing any one of the plurality of control parameters from a previous measurement point for control of the target device.

When a model of a target device is to be generated, it may be desired to perform detailed measurement for a specific state. For example, it can be considered to generate a model by acquiring fine measurement data for a region having rapid change, and acquiring rough measurement data for a region having slow change. For example, it can be also considered to generate a model by acquiring fine measurement data for a specific region where it is desired to increase the accuracy of the model, and acquiring rough measurement data for other regions.

However, in the Hilbert curve, spaces are filled uniformly. Therefore, a movement instruction by quasi-steady measurement is not generated corresponding to a requisite density, and thus measurement data of the quasi-steady measurement is not acquired with the requisite density.

SUMMARY

According to an aspect of an embodiment, a non-transitory computer-readable recording medium stores a data-acquisition-instruction generating program that causes a computer to execute a process including: first generating a plurality of change curves of each of control parameters based on requisite density information, the requisite density information being related to a data measurement density in a data measurement region specified by a combination of a plurality of control parameters, the plurality of control parameters being used by a device subject to the data measurement; and second generating a data acquisition instruction to perform measurement at a plurality of measurement points with respect to the device to be measured in an order in which change of each control parameter becomes change corresponding to the change curves, and new measurement is performed such that only one of the control parameters changes from previous measurement.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 14 is a diagram illustrating an example of prediction accuracy;

DESCRIPTION OF EMBODIMENTS

Preferred embodiments will be explained with reference to accompanying drawings. The disclosed technique is not limited to the embodiments. The following embodiments can be combined with one another within a range that any contradictions are not caused.

First Embodiment

System Configuration

In control design, it is designed how to control a target device by using a model generated based on measurement data obtained by measuring the target device, which is a target of control design. A system according to the present embodiment generates a model of a target device. In the present embodiment, a case where the target device is an engine and control design of the engine is performed is described as an example. In the control design of the engine, it is measured how a state of the engine changes by an operation of the engine in order to determine a numerical value to be used for control of the engine, and the engine is modeled based on the measured measurement data. For example, in the control design of the engine, it is measured how exhaust gas and fuel consumption change due to change of a valve opening degree and a fuel injection amount, to generate a model. In the control design of the engine, it is designed how to control the engine by using the generated model. For example, in the control design of the engine, it is designed how much a valve is opened and how much fuel injection amount is adequate in order to suppress exhaust gas and fuel consumption based on the generated model, while obtaining a requisite output.

Figure 1:
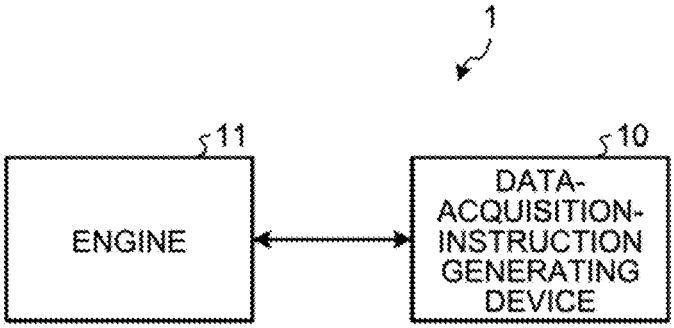
FIG. 1 is an explanatory diagram of an example of a system configuration.

FIG. 1 is an explanatory diagram of an example of a system configuration. As illustrated in FIG. 1, a system 1 includes a data-acquisition-instruction generating device 10 and an engine 11.

The engine 11 is the target of control design, and is a device to be measured.

The data-acquisition-instruction generating device 10 generates a model of the engine 11. The data-acquisition-instruction generating device 10 is an information processor such as a personal computer or a server computer. The data-acquisition-instruction generating device 10 may be implemented as one computer or may be implemented as a plurality of computers. In the present embodiment, a case where the data-acquisition-instruction generating device 10 is one computer is described as an example.

The data-acquisition-instruction generating device 10 operates the engine 11 under various measurement conditions. For example, the data-acquisition-instruction generating device 10 generates a measurement condition to be set as a control parameter to control the engine 11, and outputs a movement instruction under the generated measurement condition to the engine 11. The control parameter becomes input information to the model in the control design. As the control parameter for controlling the engine 11, for example, a valve opening degree and a fuel injection amount can be mentioned. The control parameter is not limited thereto.

The data-acquisition-instruction generating device 10 acquires measurement data indicating the state of the engine 11 under various measurement conditions. For example, the data-acquisition-instruction generating device 10 acquires measurement data indicating the state of the engine 11 under various measurement conditions in which only any one of a plurality of control parameters is changed from a previous measurement condition. At this time, the data-acquisition-instruction generating device 10 causes the value of any one of control parameters to change from the previous measurement condition at a slow speed that can be regarded substantially as steady, for each measurement condition. The data-acquisition-instruction generating device 10 regards the measurement data sequentially acquired while any one of the control parameters is caused to change at a slow speed as data in a steady state and uses the data. For example, the data-acquisition-instruction generating device 10 causes the valve opening degree and the fuel injection amount to change one after another at a slow speed that can be regarded substantially as steady, and acquires the measurement data indicating the state of the engine 11. As the measurement data, for example, the data-acquisition-instruction generating device 10 acquires respective concentrations of $NO_x$ (nitrogen oxide), PM (particulate matter), and $CO_2$ (carbon dioxide) contained in an exhaust gas, and fuel consumption data.

Configuration of Data-acquisition-Instruction Generating Device 10

Figure 2:
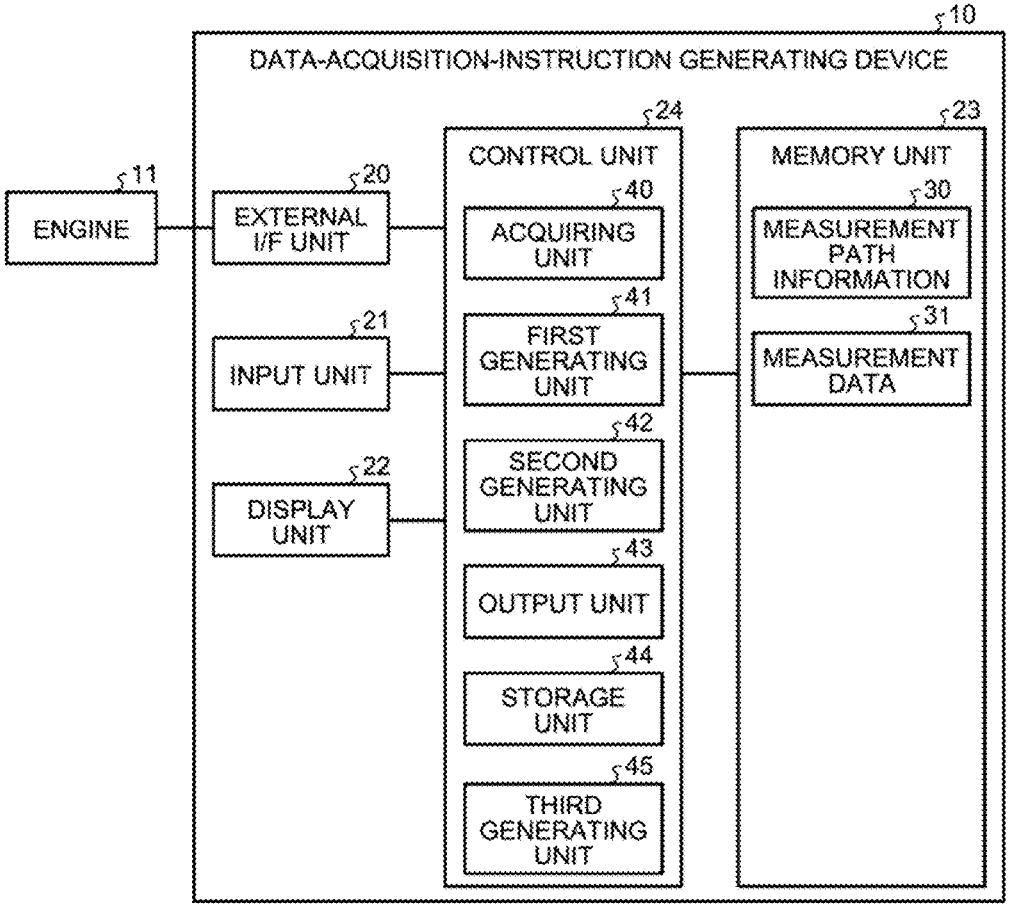
FIG. 2 is a diagram illustrating an example of a functional configuration of a data-acquisition-instruction generating device.

The data-acquisition-instruction generating device 10 according to the present embodiment is described next. FIG. 2 is a diagram illustrating an example of a functional configuration of the data-acquisition-instruction generating device. As illustrated in FIG. 2, the data-acquisition-instruction generating device 10 includes an external I/F (interface) unit 20, an input unit 21, a display unit 22, a memory unit 23, and a control unit 24. The data-acquisition-instruction generating device 10 can include units other than the units described above.

The external I/F unit 20 is an interface that performs input and output of information with respect to other devices. As the external I/F unit 20, various input and output ports such as a USB (Universal Serial Bus), and a network interface card such as a LAN card can be adopted.

The external I/F unit 20 transmits and receives various pieces of information to and from the other devices via a communication cable (not illustrated). For example, the external I/F unit 20 outputs a movement instruction that designates a measurement condition to a control device (not illustrated) that controls the engine 11. The control device causes the engine 11 to operate under the designated measurement condition. The control device measures the state of the engine 11 at a predetermined cycle. For example, the control device measures respective concentrations of $NO_x$, PM, and $CO_2$ contained in an exhaust gas of the engine 11, and the fuel consumption of the engine 11 at a cycle of 16 milliseconds. The control device outputs data indicating the measured state of the engine 11 as measurement data associated with a measurement time at a predetermined cycle. That is, the control device outputs the measurement data of each measurement in a chronological order. The external I/F unit 20 receives the measurement data output from the control device.

The input unit 21 is an input device that inputs various pieces of information. An input device that receives an operation input by a mouse or a keyboard can be mentioned as the input unit 21. The input unit 21 receives an input of various pieces of information related to control design. For example, the input unit 21 receives an input of a measurement target range in which measurement is performed by changing the control parameter, for each of control parameters for controlling the engine 11. The input unit 21 also receives an input of a change rate to change the control parameter, for each of the control parameters. Further, the input unit 21 receives an input of a period until measurement data corresponding to a measurement condition is acquired, for each of the control parameters. The period until measurement data corresponding to a measurement condition is acquired is also referred to as "dead time". Further, the input unit 21 receives an input of requisite density information related to the requisite density of measurement data of the engine 11. For example, the input unit 21 receives an input of information that specifies how finely the state of the engine 11 is to be measured for a measurement target range, as requisite density information. The input unit 21 receives an operation input from a user, and inputs operation information indicating received operation contents to the control unit 24.

The display unit 22 is a display device that displays various pieces of information. A display device such as an LCD (Liquid Crystal Display) or a CRT (Cathode Ray Tube) can be mentioned as the display unit 22. The display unit 22 displays various pieces of information. For example, the display unit 22 displays various screens such as an operation screen.

The memory unit 23 is a memory device that memorizes therein various pieces of data. For example, the memory unit 23 is a memory device such as a hard disk, an SSD (Solid State Drive), an optical disk, or the like. The memory unit 23 can be a semiconductor memory in which data can be rewritten such as a RAM (Random Access Memory), a flash memory, an NVSRAM (Non Volatile Static Random Access Memory).

The memory unit 23 memorizes therein an OS (Operating System) or various programs executed by the control unit 24. For example, the memory unit 23 memorizes therein various programs including a program for performing a model generating process described later. The memory unit 23 memorizes therein various pieces of data to be used by a program executed by the control unit 24. For example, the memory unit 23 memorizes therein measurement path information 30 and measurement data 31.

The measurement path information 30 is data in which how a measurement condition set as a control parameter is to be changed is memorized. For example, a plurality of measurement conditions as the control parameters are memorized in the measurement path information 30 in the order of the change.

The measurement data 31 is data in which the measurement data of the engine 11 is memorized. The measurement data is memorized associated with the measurement condition in the measurement data 31 for each measurement condition.

The control unit 24 is a device that controls the data-acquisition-instruction generating device 10. An electronic circuit such as a CPU (Central Processing Unit) or an MPU (Micro Processing Unit), or an integrated circuit such as an ASIC (Application Specific Integrated Circuit) or an FPGA (Field Programmable Gate Array) can be adopted as the control unit 24. The control unit 24 has an internal memory for storing therein a program that specifies various process procedures and control data, and performs various processes by using the program and the control data. The control unit 24 functions as various processing units by operating various programs. For example, the control unit 24 includes an acquiring unit 40, a first generating unit 41, a second generating unit 42, an output unit 43, a storage unit 44, and a third generating unit 45.

The acquiring unit 40 performs various acquisition. For example, the acquiring unit 40 acquires various operation instructions and various pieces of information related to control design. For example, the acquiring unit 40 causes the display unit 22 to display an operation screen related to control design, and acquires various operation instructions and various pieces of information input to the operation screen. For example, the acquiring unit 40 acquires an operation instruction to start generation of a model from the operation screen. The acquiring unit 40 acquires a measurement target range of a control parameter for each of the control parameters from the operation screen. The measurement target range of each control parameter is set by a user, for example, according to the range of the control parameter that models the engine 11. The acquiring unit 40 receives an input of a change rate at which the control parameter is changed from the operation screen for each of the control parameters for controlling the engine 11. For example, the change rate of each control parameter is set to a change rate with which the state change of the engine 11 can be regarded substantially as steady by the user, who observes the state change of the engine 11 beforehand by individually changing each control parameter. The acquiring unit 40 receives an input of the dead time for each of the control parameters. For example, the dead time of each control parameter is set by the user, who observes the state change of the engine 11 beforehand by individually changing each control parameter. The acquiring unit 40 acquires requisite density information related to the requisite density of the measurement data of the engine 11. For example, the acquiring unit 40 acquires information specifying how finely the state of the engine 11 is to be measured for the measurement target range, from the operation screen. It is set how finely and which range of the measurement target range is to be measured by the user, who observes the state change of the engine 11 beforehand by individually changing each control parameter. The acquiring unit 40 can acquire various pieces of information by reading various pieces of information from the memory unit 23. For example, the acquiring unit 40 can memorize the requisite density information beforehand in the memory unit 23 and can acquire the requisite density information from the memory unit 23.

Prediction accuracy of a model to be generated may change depending on how finely the state of the engine 11 is to be measured for the measurement target range.

Figure 3:
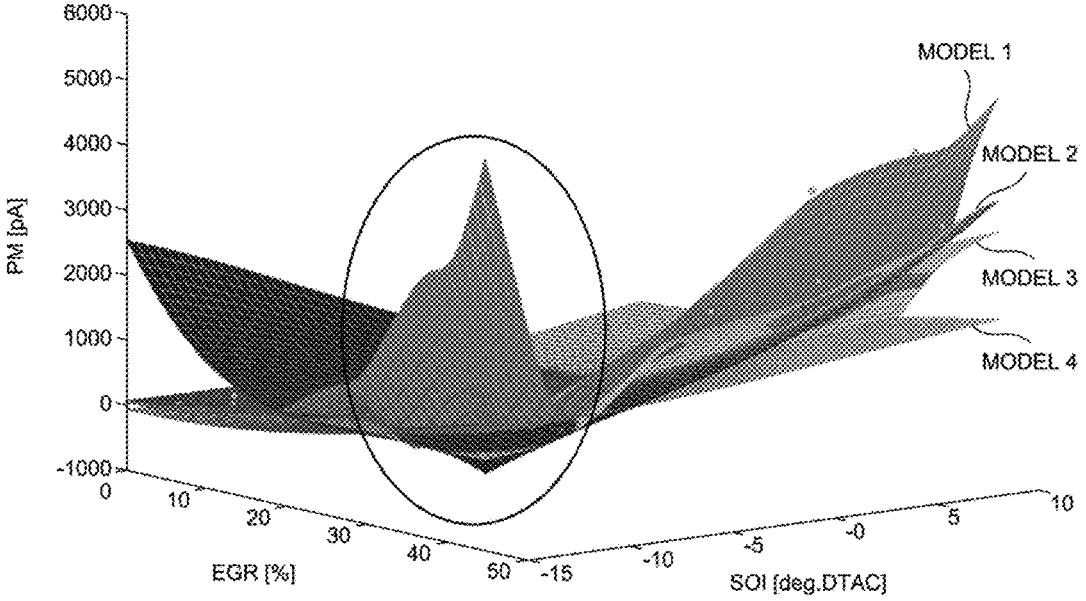
FIG. 3 is a diagram illustrating an example of a prediction result by a model.

FIG. 3 is a diagram illustrating an example of a prediction result by a model. FIG. 3 illustrates a result of predicting a generation amount of PM by four models 1 to 4 by using EGR (Exhaust Gas Recirculation) and SOI (start of injection) as control parameters. In a region where the EGR is large and the SOI is equal to or less than −10 [deg.DTAC], there is a large change in the generation amount of PM. Therefore, in the example in FIG. 3, there is a large difference in prediction results among the models 1 to 4 in the region where the EGR is large and the SOI is equal to or less than −10 [deg.DTAC]. When a model of the engine 11 is to be generated, it may be desired to perform detailed measurement regarding a specific state. For example, fine measurement data is acquired for a region where the generation amount of PM changes rapidly, and rough measurement data is acquired for a region where the generation amount of PM changes slowly, thereby improving the prediction accuracy of a model to be generated by generating a model. Therefore, the acquiring unit 40 acquires the requisite density information that specifies how finely the state of the engine 11 is to be measured for the measurement target range, as the requisite density information.

Figure 4:
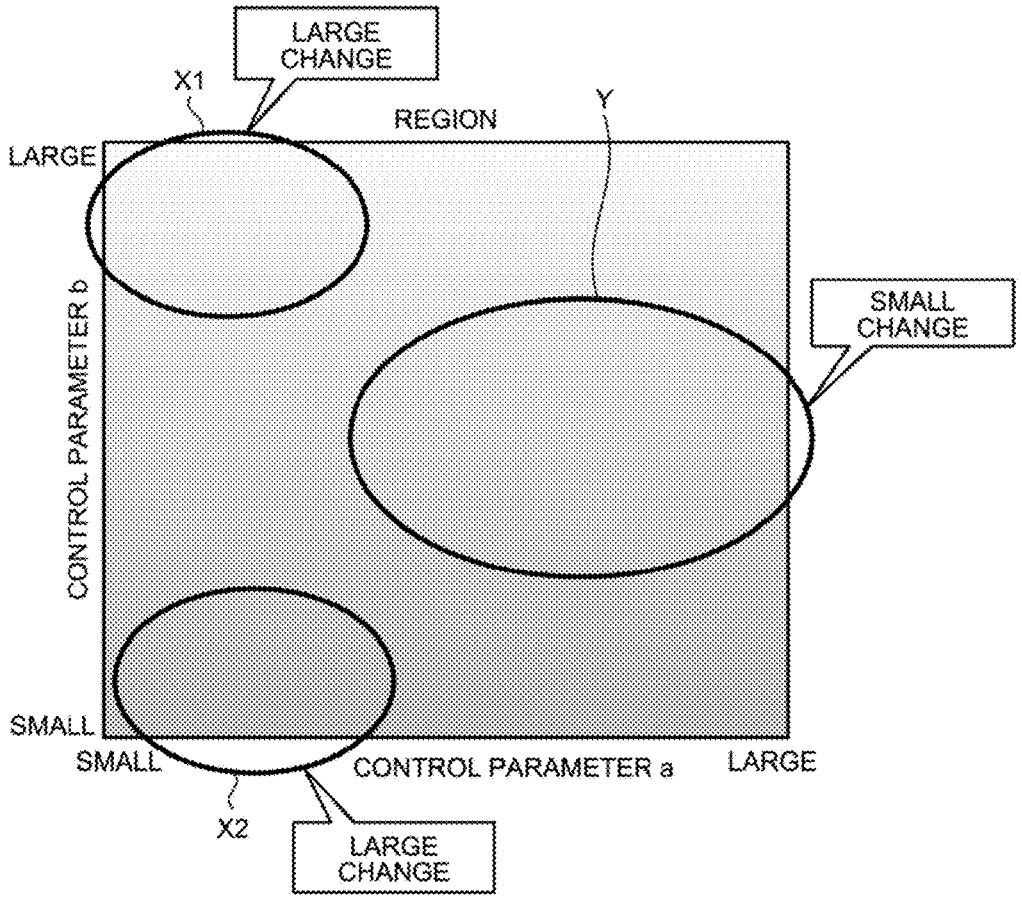
FIG. 4 is a diagram schematically illustrating an example of requisite density information.

FIG. 4 is a diagram schematically illustrating an example of requisite density information. A region to be measured is illustrated in the example in FIG. 4 by measurement target ranges of two control parameters a and b. For example, it is assumed that there is a large change in measurement data in a region X1 where the control parameter a is small and the control parameter b is large and in a region X2 where the control parameter a is small and the control parameter b is small. It is also assumed that there is a small change in the measurement data in a region Y where the control parameter a is large. In this case, for example, the user designates the requisite density so that the state of the engine 11 is measured finely as the control parameter a becomes smaller in the measurement target range thereof, and the state of the engine 11 is measured roughly in a central portion and finely at opposite end portions in the measurement target range of the control parameter b.

The first generating unit 41 generates a plurality of change curves related to each of the control parameters based on the requisite density information. For example, it is specified to measure the state of the engine 11 finely as the control parameter a becomes smaller in the measurement target range thereof. In this case, the first generating unit 41 generates a change curve of the control parameter a by using a function by which a change amount of an output value y increases with respect to a change amount of an input value x as the input value x increases. For example, when a change range of the input value x is set to −0.5 to +0.5, and the measurement target range is set to 0 to 4.4, the first generating unit 41 uses an exponential function to generate a change curve represented by the following expression (1).

$$y=\exp(1.5x+0.75) \tag{1}$$

For example, it is specified for the control parameter b so that measurement is performed roughly at the central portion in the measurement target range and finely at the opposite ends. In this case, the first generating unit 41 uses a function by which the change amount of the output value y decreases with respect to the change amount of the input value x, as the input value x increases from zero in positive and negative directions, to generate a change curve of the control parameter b. For example, when the change range of the input value x is set to −0.5 to +0.5, and the measurement target range is set to −1.38 to +1.38, the first generating unit 41 uses a tan h function for the control parameter b to generate a change curve represented by the following expression (2).

$$y=3\times\tan h(x) \tag{2}$$

The second generating unit 42 generates a data acquisition instruction at the time of performing measurement of the engine 11. For example, the second generating unit 42 generates data acquisition instructions to be performed in the order in which change of each control parameter becomes change corresponding to a plurality of change curves, and new measurement is performed such that only one of the control parameters changes from the previous measurement. For example, the second generating unit 42 uses a space-filling curve to be arranged in a normalized space in which the measurement target range of each of the control parameters is normalized, to generate a plurality of measurement conditions. The space-filling curve comprehensively changes in the space by means of the control parameters by sequentially changing the value of any one of the control parameters in the space. As the space-filling curve, for example, the Hilbert curve is used.

Figure 5:
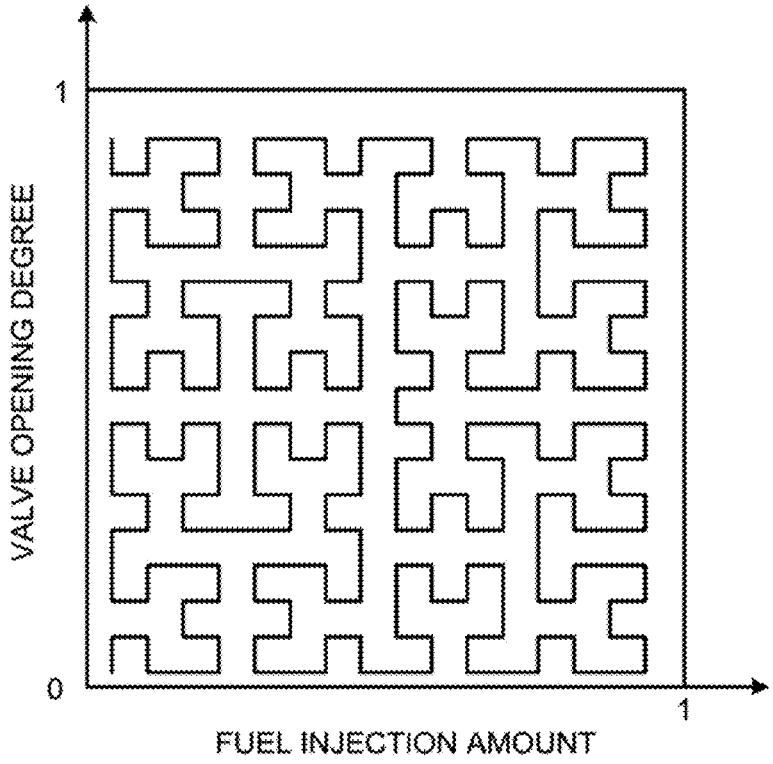
FIG. 5 is a diagram illustrating an example of a normalized space.
Figure 6:
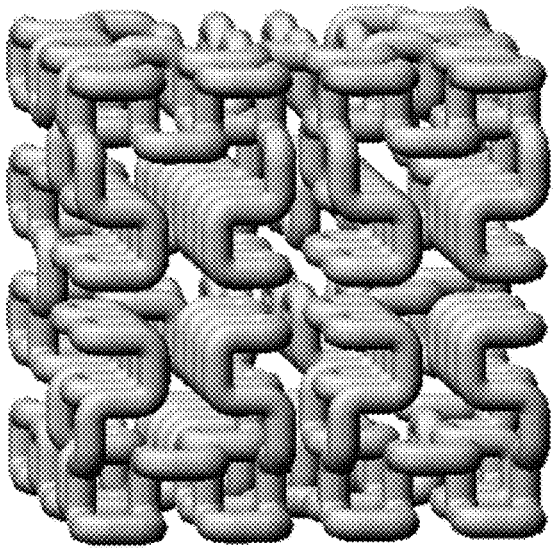
FIG. 6 is a diagram illustrating an example of a three-dimensional Hilbert curve.

A flow for generating the measurement condition is described here by using a specific example. A case where the control parameter for controlling the engine 11 is set to two control parameters, that is, a valve opening degree and a fuel injection amount is described below as an example. The second generating unit 42 normalizes the measurement target range of each of the valve opening degree and the fuel injection amount for controlling the engine 11 to ranges from 0 to 1. FIG. 5 is a diagram illustrating an example of a normalized space. The normalized space in which the measurement target ranges of the valve opening degree and the fuel injection amount are normalized becomes a two-dimensional space in which the valve opening degree and the fuel injection amount are in a range from 0 to 1. The second generating unit 42 arranges the Hilbert curve in the normalized space. In the example of FIG. 5, an example of a two-dimensional Hilbert curve is illustrated. The Hilbert curve is one of fractal diagrams acquired by recursively repeating a trajectory pattern having a U shape, and is one of space-filling curves in which a limit of iteration matches with a region. The Hilbert curve is a traversable curve configured by a combination of respective change of one parameter. Because the Hilbert curve is a space-filling curve, a curve obtained by repeating the trajectory pattern having a U shape to some extent comprehensively fills the region. Further, in the Hilbert curve, there are portions having reciprocal change in most portions in the vicinity. The Hilbert curve can be also created in any dimensional space. FIG. 6 is a diagram illustrating an example of a three-dimensional Hilbert curve.

An example of a construction method of a two-dimensional Hilbert curve is described. There are four different two-dimensional Hilbert curves of (RUL(n); DLU(n); LDR(n); URD(n)) due to a difference of start conditions. Here, n is the number of iterations (order). The Hilbert curve of each order is drawn by rules represented by the following expressions (3-1) to (3-4).

$$RUL(n)=URD(n-1)\rightarrow RUL(n-1)\uparrow RUL(n-1)\leftarrow DLU(n-1) \tag{3-1}$$

$$DLU(n)=LDR(n-1)\downarrow DLU(n-1)\leftarrow DLU(n-1)\uparrow RUL(n-1) \tag{3-2}$$

$$LDR(n)=DLU(n-1)\leftarrow LDR(n-1)\downarrow LDR(n-1)\rightarrow URD(n-1) \tag{3-3}$$

$$URD(n)=RUL(n-1)\uparrow URD(n-1)\rightarrow URD(n-1)\downarrow LDR(n-1) \tag{3-4}$$

However, it is assumed that RUL(0)=DLU(0)=LDR(0)=URD(0)=" ". " " means there is no operation.

Figure 7:
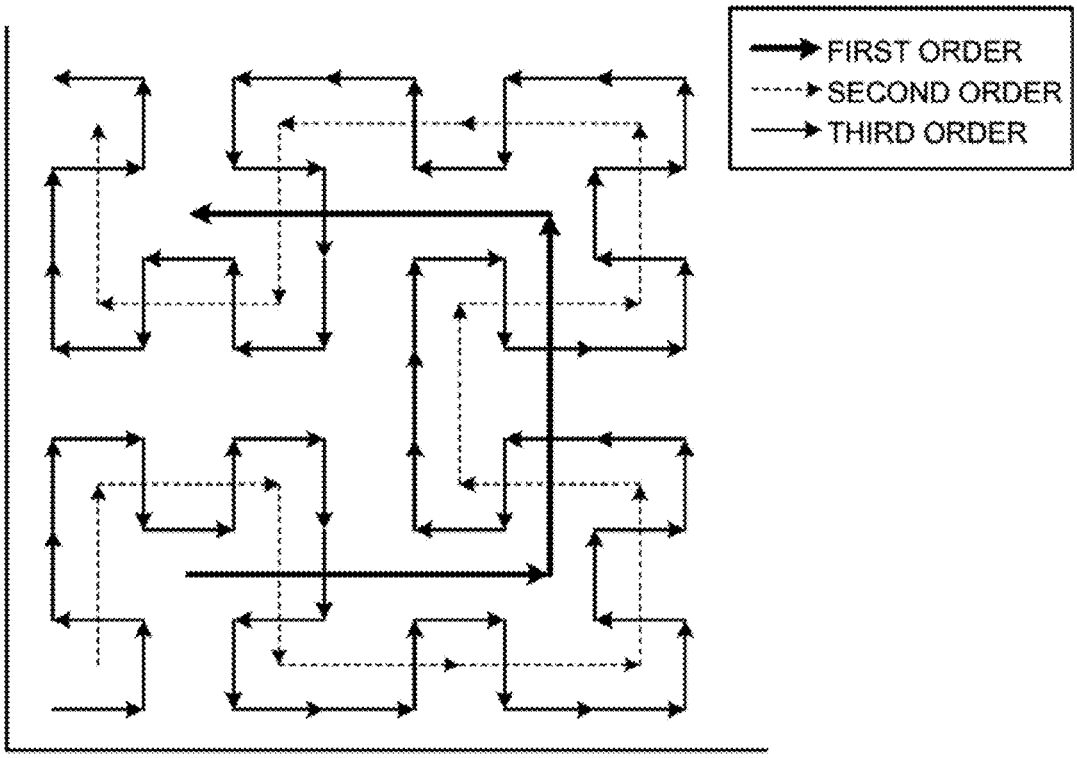
FIG. 7 is a diagram illustrating an example of two-dimensional Hilbert curves from the first order to the third order.

RUL(n) is specifically described. The Hilbert curve RUL(n) is constructed by equally dividing each side of a square region into 2n to divide the region into small square regions, and connecting by a line segment from the center of the bottom left small square region toward the center of the adjacent square region sequentially along an arrowed line. FIG. 7 is a diagram illustrating an example of the two-dimensional Hilbert curve from the first order to the third order.

The Hilbert curve RUL(1) with the order n being 1 becomes as follows based on the expression (3-1).

$$RUL(1)=URD(0)\rightarrow RUL(0)\uparrow RUL(0)\leftarrow DLU(0)=\rightarrow\uparrow\leftarrow$$

The Hilbert curve RUL(1) is obtained by connecting the centers of four small square regions obtained by equally dividing each side of a square region into two in an order of lower left, lower right, upper right, and upper left.

Similarly, the Hilbert curve RUL(2) with the order n being 2 becomes as follows.

$$RUL(2) = URD(1) \rightarrow RUL(1) \uparrow RUL(1) \leftarrow DLU(1)$$

$$= (\uparrow \rightarrow \downarrow) \rightarrow (\rightarrow \uparrow \leftarrow) \uparrow (\rightarrow \uparrow \leftarrow) \leftarrow (\downarrow \leftarrow \uparrow)$$

$$= \uparrow \rightarrow \downarrow \rightarrow \rightarrow \uparrow \leftarrow \uparrow \rightarrow \uparrow \leftarrow \leftarrow \downarrow \leftarrow \uparrow$$

The Hilbert curve RUL(2) is a curve obtained by connecting the centers of 16 small square regions obtained by equally dividing each side of a square region into four from the bottom left in the order of arrowed lines.

The second generating unit 42 normalizes the measurement target range of each of the valve opening degree and the fuel injection amount to ranges from 0 to 1. The second generating unit 42 arranges the Hilbert curve such that the center of the bottom left small square in the normalized two-dimensional normalized space becomes (0;0) and the center of the top right small square becomes (1;1) in association with each other. The second generating unit 42 converts a coordinate for translating the normalized space where the Hilbert curve is arranged, so that the coordinate of the center of the region where the Hilbert curve is arranged becomes (0;0). For example, the second generating unit 42 converts a coordinate for translating the normalized space such that (0;0) in the normalized space becomes (−0.5;−0.5), (−0.5;−0.5) becomes (0;0), and (1;1) becomes (0.5;0.5). Accordingly, the region of the normalized space where the Hilbert curve is arranged becomes a range in which the ranges of the valve opening degree and the fuel injection amount are respectively in the range of −0.5 to +0.5.

Figure 8:
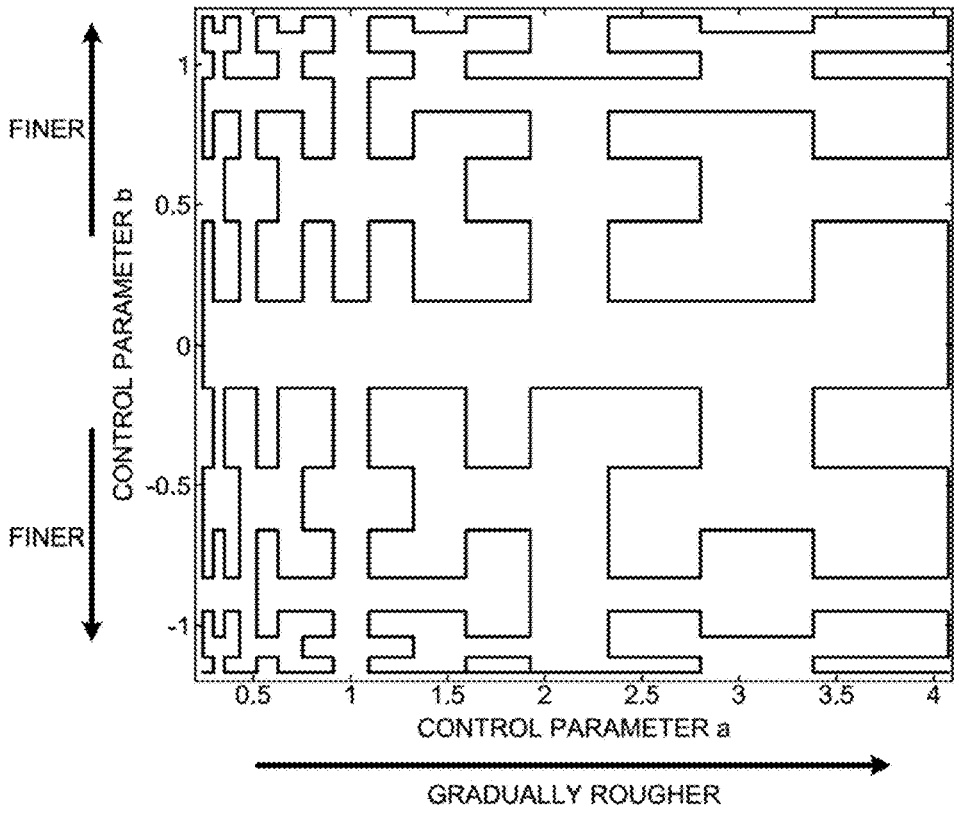
FIG. 8 is a diagram illustrating an example of a measurement path curve.

The second generating unit 42 associates the Hilbert curve arranged in the normalized space with the space of the respective measurement target ranges of the valve opening degree and the fuel injection amount by using the change curves generated for each of the control parameters. For example, the second generating unit 42 converts the value of the control parameter on the Hilbert curve arranged in the normalized space by a change curve of the control parameter into a curve in the space of the measurement target range. A curve obtained by associating the Hilbert curve with the space of the measurement target range becomes a measurement path curve indicating a path of actual measurement. For example, if a change curve of the control parameter a is the expression (1), the second generating unit 42 inputs a value from −0.5 to +0.5 of the normalized control parameter a obtained from the Hilbert curve in x of the expression (1), to return the value to a value from 0 to 4.4, which is the measurement target range. If a change curve of the control parameter b is the expression (2), the second generating unit 42 inputs a value from −0.5 to +0.5 of the normalized control parameter b obtained from the Hilbert curve in x of the expression (2), to return the value to a value from −1.38 to +1.38, which is the measurement target range. FIG. 8 is a diagram illustrating an example of a measurement path curve. In the measurement path curve illustrated in FIG. 8, the value of the control parameter a becomes finer (has a higher density) as the value decreases, and becomes rougher (has a lower density) as the value increases in a range from 0 to 4.4. Further, in the measurement path curve illustrated in FIG. 8, the value of the control parameter b becomes rougher (has a lower density) in a central portion and becomes finer (has a higher density) at the opposite end portions in a range from −1.38 to +1.38.

The second generating unit 42 generates a measurement condition along the measurement path curve. Also in the original space, only any one of the control parameters changes in the measurement path curve. The second generating unit 42 generates a measurement condition that changes the changing value of the control parameter at a change rate of the control parameter along the measurement path curve. For example, if the change rate of the control parameter is one per second, the second generating unit 42 generates a measurement condition that changes the value of the control parameter by one per second. Accordingly, a measurement condition is generated such that only any one of the control parameters changes from the previous measurement condition, and the respective control parameters comprehensively change in the space by means of the measurement target range of each of the control parameters.

The second generating unit 42 memorizes the generated measurement condition in an order along the measurement path curve in the measurement path information 30. That is, the second generating unit 42 memorizes a plurality of measurement conditions in the measurement path information 30, associated with the order of change.

The output unit 43 causes the control device (not illustrated) that controls the engine 11 to output a movement instruction specifying the measurement condition from the external I/F unit 20. For example, the output unit 43 outputs a movement instruction for driving the engine 11 under the measurement condition along the sequence of the order of the measurement conditions memorized in the measurement path information 30. The control parameter is changed to the measurement condition, and the engine 11 is driven under the measurement condition. In the engine 11, any one of control parameters changes at a slow speed that can be regarded as steady by the movement instruction. The external I/F unit 20 receives the measurement data indicating the state of the engine 11 in which the control parameter is changed to the measurement condition in a chronological order. The measurement data received in a chronological order can be regarded as steady-state data.

The storage unit 44 acquires the measurement data indicating the state of the engine 11, which is received by the external I/F unit 20. The storage unit 44 stores the acquired measurement data associated with the measurement condition in the measurement data 31. In the engine 11, even if the measurement condition is changed, the reaction takes time, and thus there is a dead time until measurement data corresponding to the measurement condition is acquired.

Figure 9:
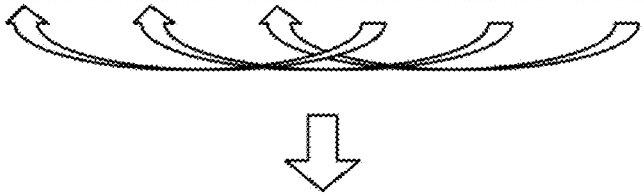
FIG. 9 is an explanatory diagram of association between measurement data and measurement conditions.

Therefore, the storage unit 44 specifies a control parameter, whose value has been changed under the measurement condition in the movement instruction output from the output unit 43. The storage unit 44 stores the acquired measurement data in the measurement data 31, associated with the measurement condition of the specified control parameter the dead time earlier. FIG. 9 is an explanatory diagram of association between measurement data and measurement conditions. In the example illustrated in FIG. 9, the measurement condition is changed from U(1) to U(6) during times 1 to 6. Further, pieces of measurement data X(1) to X(6) are acquired in times 1 to 6. In the example illustrated in FIG. 9, it is assumed that there are three dead times. In this case, the storage unit 44 stores the measurement data associated with the measurement condition three hours earlier (three steps before). In the example illustrated in FIG. 9, the measurement conditions U(1) to U(6) and the measurement data X(4) to X(9) to be associated with each other are stored in the measurement data 31. Accordingly, the measurement data that can be regarded as being a steady state is memorized in the measurement data 31 for each of the measurement conditions.

Figure 10:
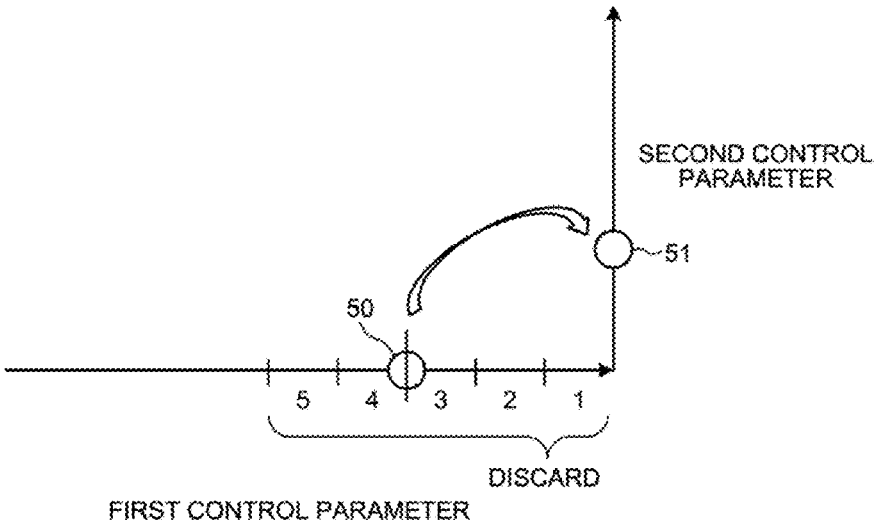
FIG. 10 is an explanatory diagram of change of a control parameter whose value is changed.

In the measurement according to the present embodiment, the control parameter whose value changes depending on the measurement condition during the dead time may be changed. FIG. 10 is an explanatory diagram of change of a control parameter whose value is changed. An example illustrated in FIG. 10 illustrates a timing at which the control parameter whose value changes is changed from the first control parameter to the second control parameter. The measurement data at a timing 50 at which the first control parameter is being changed is acquired at a timing 51 after the dead time. In the example illustrated in FIG. 10, at the timing 51, the second control parameter is changing. Thus, if the control parameter whose value changes is changed during the dead time, the measurement data may be affected by the change of the control parameter whose value changes. Therefore, if the control parameter whose measurement condition changes is changed, the storage unit 44 discards the measurement data for a period of the dead time after the control parameter has been changed. In the example illustrated in FIG. 10, the storage unit 44 discards the measurement data for a period of five measurement cycles, which is the dead time of the first control parameter after the timing when the control parameter whose value changes has been changed, without storing the measurement data in the measurement data 31. Accordingly, a model can be generated by excluding measurement data, which may have been affected by the change of a plurality of control parameters. Thus, when the measurement data is to be discarded, it is desired to set the order n of the Hilbert curve to about 3 to 5. This is because as the order of the Hilbert curve becomes higher, there are more change points at which the control parameter whose value changes is changed, and more pieces of measurement data are discarded.

The third generating unit 45 generates a model of the engine 11. For example, the third generating unit 45 performs machine learning by using the measurement conditions memorized in the measurement data 31 and the measurement data corresponding to the measurement conditions for each type of the measurement data, to generate a model. For example, the third generating unit 45 generates a model by using a method of outputting a weighted mean of peripheral data by means of regression analysis using LOLIMOT (Local Linear Model Tree) or a Gaussian process for each concentration of NOx, PM, and $CO_2$ and each fuel consumption. Accordingly, the concentration of NOx, PM, and $CO_2$ and the fuel consumption under various measurement conditions can be predicted based on the generated model.

In the related quasi-steady measurement, the measurement data can be acquired only for one control parameter. With an increase of the number of devices or the like, a target device, which is the target of control design, may have a plurality of control parameters to control these devices. Therefore, only by using the quasi-steady measurement for only one control parameter, the correlation with other control parameters is not expressed. For example, in the control parameters, a slow speed of the quasi-steady conditions is different from each other depending on the change direction. Therefore, when the plurality of control parameters are to be changed simultaneously, infinite speed setting is needed, which is substantially impossible. Further, when the control parameters are to be changed simultaneously, the dead time is different depending on the change direction, and thus association that corrects the portion of the dead time is difficult. Therefore, in the related quasi-steady measurement, quasi-steady data collection for the control parameters is difficult. In the control parameters, there may be a control parameter having strong non-linearity, and thus an accurate model is not generated only by the measurement data of one control parameter.

On the other hand, the data-acquisition-instruction generating device 10 according to the present embodiment generates a measurement condition in which any one of the control parameters for controlling the target device is changed from a previous measurement condition. Therefore, the data-acquisition-instruction generating device 10 can easily set the change speed of the control parameter and the dead time of the control parameter. Further, the data-acquisition-instruction generating device 10 according to the present embodiment generates a measurement condition that changes comprehensively in a space of a measurement target range of each of the control parameters for controlling the target device. Therefore, the data-acquisition-instruction generating device 10 can collect measurement data sufficiently even if there is a control parameter having strong non-linearity, and can generate an accurate model.

Furthermore, if the state of the engine 11 is measured in detail for a specific region of the measurement target range, the data-acquisition-instruction generating device 10 according to the present embodiment can generate a movement instruction by means of quasi-steady measurement by associating the specific region with a requisite density.

Figure 11:
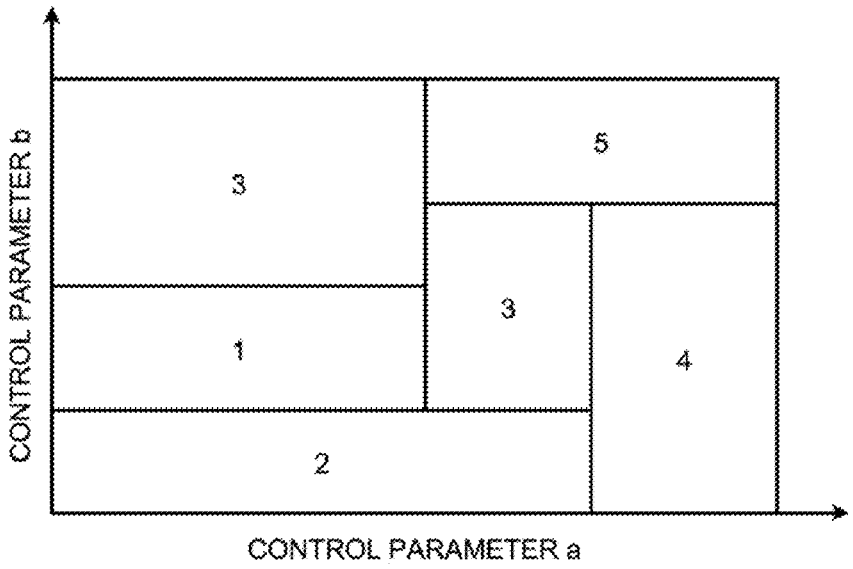
FIG. 11 is a diagram illustrating an example of a weight value for each region of a measurement target range.

Another example of a method of designation of a requisite density of measurement data is described next. For example, requisite density information can be a weight value for each region of a measurement target range of each of control parameters. FIG. 11 is a diagram illustrating an example of a weight value for each region of the measurement target range. The example in FIG. 11 illustrates a case where a weight value is designated as the requisite density for each region of the measurement target range of the two control parameters a and b. It is assumed that as the weight value increases, finer measurement (having a higher density) is designated. The acquiring unit 40 acquires the requisite density information in which the weight value for each region of the measurement target range is designated. For example, the acquiring unit 40 can display the space of the measurement target range on the operation screen, and receive designation of the weight value for each region of the space. For example, the requisite density information in which the weight value is designated for each region of the space can be memorized in the memory unit 23 beforehand, and the acquiring unit 40 can acquire the requisite density information from the memory unit 23.

Figure 12:
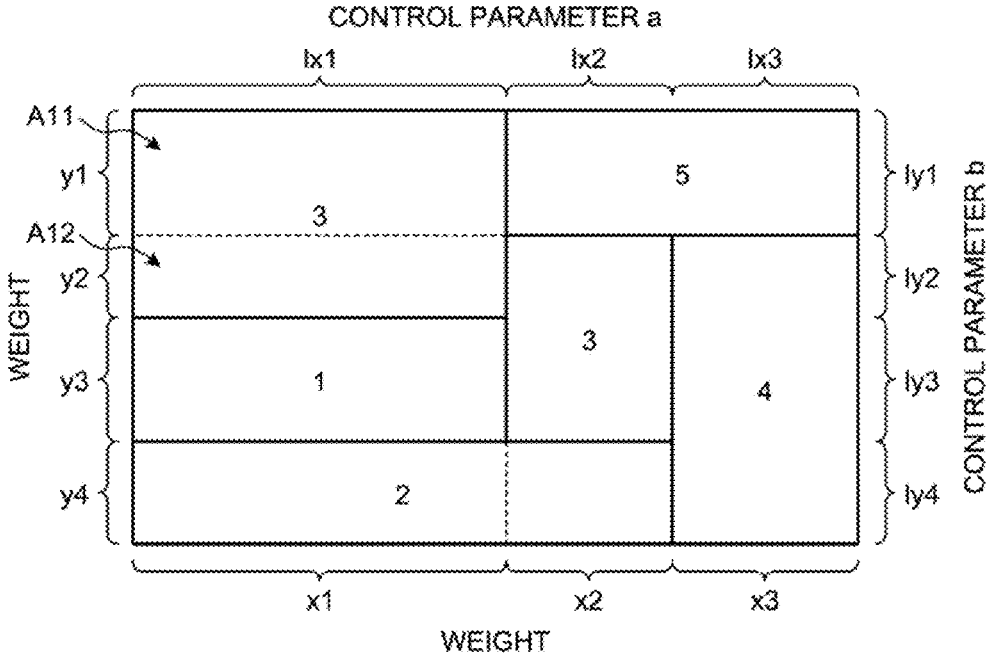
FIG. 12 is an explanatory diagram of how to obtain a weight value for each segmentalized range of each of control parameters.

The first generating unit 41 obtains a weight value for each range obtained by segmentalizing the measurement target range of each of the control parameters by a point that becomes a boundary of the regions. FIG. 12 is an explanatory diagram of how to obtain the weight value for each segmentalized range of each of the control parameters. The first generating unit 41 segmentalizes the measurement target range of each of the control parameters a and b by a boundary point of the respective regions to which a weight is designated. In the example in FIG. 12, the measurement target range of the control parameter a is segmentalized into three ranges of ranges lx1, lx2, and lx3. The measurement target range of the control parameter b is segmentalized into four ranges of ranges ly1, ly2, ly3, and ly4.

The first generating unit 41 obtains a weight value reflecting the weight value of each region so as to maintain the weight value thereof as much as possible for each of the segmentalized ranges. As to how to obtain the weight value for each of the segmentalized ranges is described next. The first generating unit 41 normalizes the length of each range of the control parameter by the length of the measurement target range, for each of the control parameters. In the case of FIG. 12, the first generating unit 41 obtains normalized lengths dx1, dx2, dx3, dy1, dy2, dy3, and dy4 as represented by the following expressions (4-1) to (4-7), regarding the ranges lx1, lx2, lx3, ly1, ly2, ly3, and ly4.

$$lx1:\ dx1=lx1/(lx1+lx2+lx3) \quad (4\text{-}1)$$

$$lx2:\ dx2=lx2/(lx1+lx2+lx3) \quad (4\text{-}2)$$

$$lx3:\ dx3=lx3/(lx1+lx2+lx3) \quad (4\text{-}3)$$

$$ly1:\ dy1=ly1/(ly1+ly2+ly3+ly4) \quad (4\text{-}4)$$

$$ly2:\ dy2=ly2/(ly1+ly2+ly3+ly4) \quad (4\text{-}5)$$

$$ly3:\ dy3=ly3/(ly1+ly2+ly3+ly4) \quad (4\text{-}6)$$

$$ly4:\ dy4=ly4/(ly1+ly2+ly3+ly4) \quad (4\text{-}7)$$

The first generating unit 41 obtains the weight value of each range reflecting the designated weight value of the region including each range for each of the segmentalized ranges. For example, in the case of FIG. 12, it is assumed that the weight values of the ranges lx1, lx2, lx3, ly1, ly2, ly3, and ly4 are x1, x2, x3, y1, y2, y3, and y4. The first generating unit 41 obtains the weight values x1, x2, x3, y1, y2, y3, and y4 by solving the following optimum problems. For example, objective functions are defined as represented by the following expression (5).

$$\begin{aligned}&dx1\times dy1\times(x1\times y1-3)^2+dx1\times dy2\times(x1\times y2-3)^2+dx1\times\\&\quad dy3\times(x1\times y3-1)^2+dx1\times dy4\times(x1\times y4-2)^2+dx2\times\\&\quad dy1\times(x2\times y1-5)^2+dx2\times dy2\times(x2\times y2-3)^2+dx2\times\\&\quad dy3\times(x2\times y3-3)^2+dx2\times dy4\times(x2\times y4-2)^2+dx3\times\\&\quad dy1\times(x3\times y1-5)^2+dx3\times dy2\times(x3xy2-4)^2+dx3\times\\&\quad dy3\times(x3\times y3-4)^2+dx3\times dy4\times(x4\times y4-4)^2\end{aligned} \quad (5)$$

For example, the term "dx1×dy1×(x1×y1−3)$^2$" of the expression (5) is a term related to a region A11 corresponding to the range lx1 and the range ly1. The "dx1×dy1×(x1×y1−3)$^2$" is obtained by multiplying a normalized area "dx1×dy1" of the region A11 by a squared error of a multiplication value between the weight value "x1" of the range lx1 and the weight value "y1" of the range ly1 and a weight value "3" of the region A11. The term "dx1×dy2×(x1×y2-3)$^2$" of the expression (5) is a term related to a region A12 corresponding to the range lx1 and the range ly2. The term "dx1×dy2×(x1×y2−3)$^2$" is obtained by multiplying a normalized area "dx1×dy2" of the region A12 by a squared error of a multiplication value between the weight value "x1" of the range lx1 and the weight value "y2" of the range ly2 and a weight value "3" of the region A12. The other terms of the expression (5) are the same. The expression (5) sums up values obtained by multiplying an error between the designated weight value of each region divided into the segmentalized ranges and a multiplied value of the weight values of the range corresponding to the regions by the normalized area of the region. In the expression (5), if the designated weight value of each region divided into the segmentalized ranges is appropriately reflected in the weight value of the range corresponding to the region, the value becomes small.

The first generating unit 41 obtains the weight values x1, x2, x3, y1, y2, y3, and y4 of the ranges lx1, lx2, lx3, ly1, ly2, ly3, and ly4 by solving the optimum problems that minimize a value obtained from the objective function of the expression (5) under a constraint condition represented by the following expression (6).

$$\text{Weight value } x1,x2,x3,y1,y2,y3,y4>0 \quad (6)$$

The first generating unit 41 generates a change curve corresponding to the weight value for each range of the control parameter for each of the control parameters. For example, the first generating unit 41 calculates a regular weighted sum s of the weight values for each of the ranges. For example, it is assumed that the measurement target range of the control parameter is [0, 40]. Further, it is assumed that a weight value of the range of [0, 20] is "1", a weight value of the range of [20, 30] is "2", and a weight value of the range of [30, 40] is "3" for the control parameter. In this case, the first generating unit 41 calculates the regular weighted sum s as represented by the following expression (7).

$$s=[1\times(20-0)+2\times(30-20)+3\times(40-30)]/(40-0)=7/4 \quad (7)$$

The first generating unit 41 normalizes such that the measurement target range of each of the control parameters becomes [0, 1]. Accordingly, the range of [0, 20] is normalized to be [0, 0.5]. The range of [20, 30] is normalized to be [0.5, 0.75]. The range of [30, 40] is normalized to be [0.75, 1].

The first generating unit 41 designates a value obtained by dividing the weight value for each range by the regular weighted sum s as an inclination of a range obtained by normalizing the range. For the range of [0, 0.5] obtained by normalizing the range of [0, 20], by dividing the weight value "1" by the regular weighted sum "7/4", the inclination is obtained as "4/7". For the range of [0.5, 0.75] obtained by normalizing the range of [20, 30], by dividing the weight value "2" by the regular weighted sum "7/4", the inclination is obtained as "8/7". For the range of [0.75, 1] obtained by normalizing the range of [30, 40], by dividing the weight value "3" by the regular weighted sum "7/4", the inclination is obtained as "12/7".

The first generating unit 41 obtains a function of each line segment that continuously connects the respective ranges by the line segment having the obtained inclination. For example, when it is assumed that the inclination of the range of [0, 0.5] is [4/7], the inclination of the range of [0.5, 0.75] is [8/7], and the inclination of the range of [0.75, 1] is [12/7], the functions of the respective line segments are obtained as represented by the following expressions (8-1) to (8-3).

$$y=(4/7)\times x(x=0 \text{ to } 0.5) \quad (8\text{-}1)$$

$$y=(8/7)\times x-4/14(x=0.5 \text{ to } 0.75) \quad (8\text{-}2)$$

$$y=(12/7)\times x-5/7(x=0.75 \text{ to } 1) \quad (8\text{-}3)$$

The first generating unit 41 obtains an inverse function of the function of each line segment. For example, the inverse functions of the functions represented by the expressions (8-1) to (8-3) are obtained as represented by the following expressions (9-1) to (9-3).

$$y=(7/4)\times x(x=0 \text{ to } 2/7) \quad (9\text{-}1)$$

$$y=(7/8)\times x+1/4(x=2/7 \text{ to } 4/7) \quad (9\text{-}2)$$

$$y=(7/12)\times x+5/12(x=4/7 \text{ to } 1) \quad (9\text{-}3)$$

The first generating unit 41 returns the respective inverse functions respectively to the measurement target ranges. For example, if the measurement target range is [a, b], the first generating unit 41 multiplies the inverse function by b-a, and adds a. The first generating unit 41 designates the respective functions obtained by returning the respective inverse functions respectively to the measurement target ranges as change curves. The first generating unit 41 obtains the change curve for each of the control parameters.

The second generating unit 42 uses the change curve generated for each of the control parameters to associate the Hilbert curve arranged in the normalized space with the space in the measurement target range. Accordingly, a curve obtained by associating the Hilbert curve with the space in the measurement target range deforms according to the weight value for each range, such that as the weight value decreases, the curve deforms finely (has a higher density), and as the weight value increases, the curve deforms roughly (has a lower density).

Another example of the method of designation of a requisite density of measurement data is described next. For example, the requisite density information can be a function representing a weight corresponding to a control parameter value for a measurement target range of each of the control parameters. The acquiring unit 40 acquires a function representing a weight corresponding to the control parameter value as the requisite density information, for each of the control parameters. For example, the acquiring unit 40 can receive an input of a function representing a weight corresponding to the control parameter value for each of the control parameters. For example, the requisite density information memorizing the function representing a weight corresponding to the control parameter value is memorized in the memory unit 23 beforehand for each of the control parameters, and the acquiring unit 40 can acquire the requisite density information from the memory unit 23.

The first generating unit 41 obtains a conversion function normalizing change of the function in the measurement target range of each of the control parameters based on the requisite density information. The first generating unit 41 then generates a change curve by converting the inverse function of the conversion function into the measurement target range. For example, it is assumed that the measurement target range of the control parameter is [a, b] and a function representing the weight of the control parameter is f. The first generating unit 41 converts the function f into a function g of a range of [0, 1] by performing conversion as represented by the following expression (10).

$$f \rightarrow (f-a)/(b-a)=g \tag{10}$$

The first generating unit 41 normalizes the function g by converting the function g as represented by the following expression (11) to obtain a conversion function h.

$$h(x) := \frac{\int_0^x g(t)dt}{\int_0^1 g(t)dt} \tag{11}$$

The first generating unit 41 obtains an inverse function i of the conversion function h. The first generating unit 41 returns the inverse function i to the measurement target range, respectively. For example, if the measurement target range is [a, b], the first generating unit 41 converts the inverse function into a function j of the measurement target range by performing conversion as represented by the following expression (12).

$$i \rightarrow (b-a)i+a=j \tag{12}$$

The first generating unit 41 designates the function j as a change curve. The first generating unit 41 obtains the change curve for each of the control parameters.

The second generating unit 42 uses the change curve generated for each of the control parameters to associate the Hilbert curve arranged in the normalized space with the space in the measurement target range. Accordingly, a curve obtained by associating the Hilbert curve with the space in the measurement target range deforms according to the weight value calculated from the function, such that as the weight value decreases, the curve deforms finely (has a higher density), and as the weight value increases, the curve deforms roughly (has a lower density).

Figure 13:
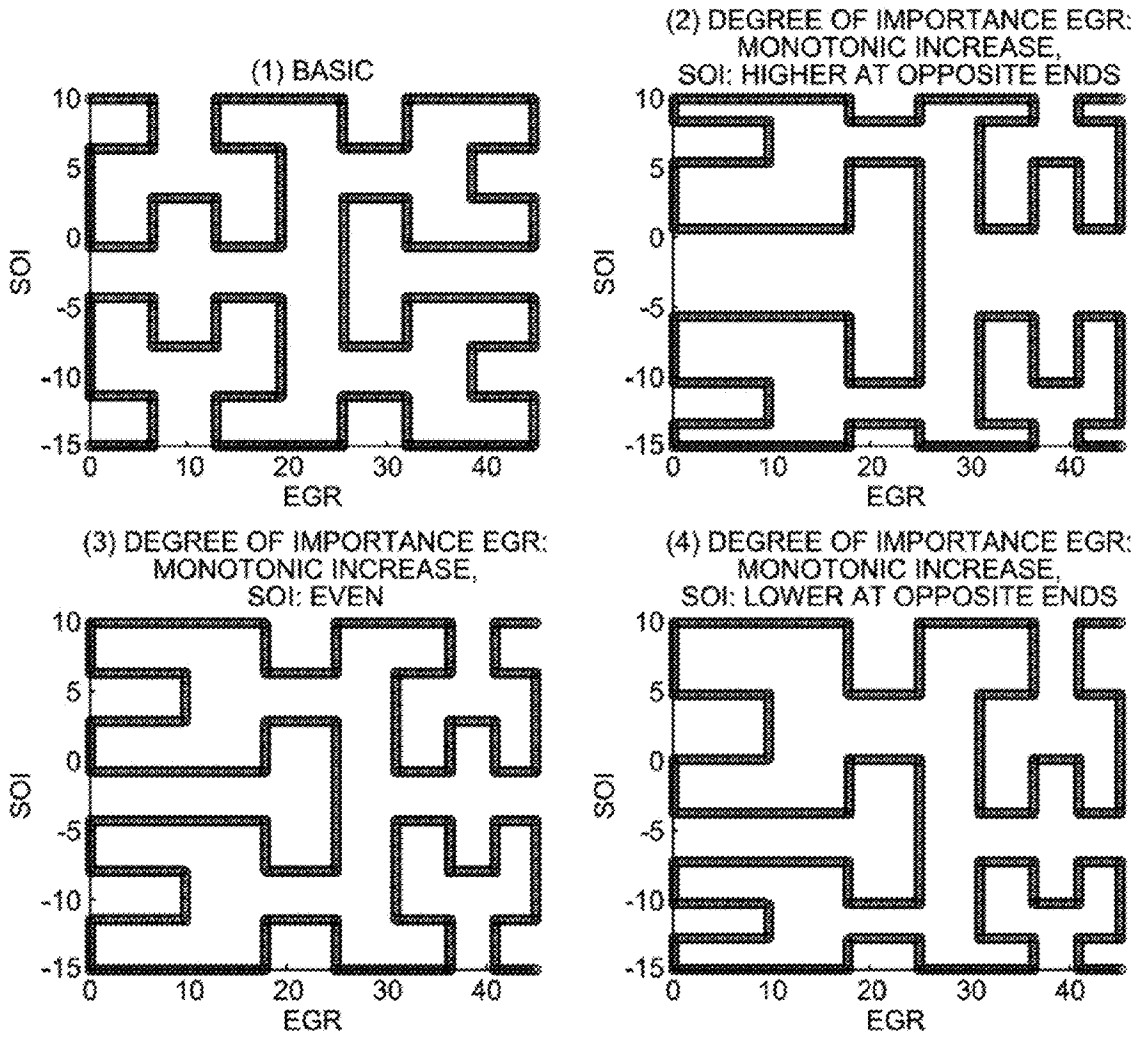
FIG. 13 is a diagram illustrating an example of a measurement path curve.

FIG. 13 is a diagram illustrating an example of a measurement path curve. (1) to (4) in FIG. 13 illustrate an example of a change curve when a generation amount of PM is to be measured by using the EGR and the SOI as the control parameters. (1) in FIG. 13 illustrates a case where a degree of importance of the measurement target range of the EGR and the SOI is set uniformly, to measure the measurement target range of the EGR and the SOI with an equal density. (2) in FIG. 13 illustrates a case where the degree of importance is set higher as the measurement target range of the EGR becomes larger, and the degree of importance is set higher as moving closer to the opposite ends of the measurement target range of the SOI, to measure the measurement target range of the EGR with a higher density as the EGR increases, and the measurement target range of the SOI with a higher density as moving closer to the opposite ends of the measurement target range of the SOI. (3) in FIG. 13 illustrates a case where the degree of importance is set higher as the measurement target range of the EGR becomes larger, and the degree of importance of the measurement target range of the SOI is set uniformly, to measure the measurement target range of the EGR with a higher density as the EGR increases. (4) in FIG. 13 illustrates a case where the degrees of importance are set higher as the measurement target ranges of the EGR and the SOI become larger, to measure the measurement target range of the EGR and the SOI with a higher density as the EGR and the SOI become large.

FIG. 14 is a diagram illustrating an example of prediction accuracy. FIG. 14 illustrates prediction accuracy of the generation amount of PM predicted based on four models 1 to 4, designating the EGR and the SOI as control parameters. The model 1 in FIG. 14 illustrates prediction accuracy of a model generated based on measurement data measured by the measurement path curve illustrated in (1) in FIG. 13. The model 2 illustrates prediction accuracy of a model generated based on measurement data measured by the measurement path curve illustrated in (2) in FIG. 13. The model 3 illustrates prediction accuracy of a model generated based on measurement data measured by the measurement path curve illustrated in (3) in FIG. 13. The model 4 illustrates prediction accuracy of a model generated based on measurement data measured by the measurement path curve illustrated in (4) in FIG. 13. It is assumed that as the EGR and the SOI become large, the generation amount of PM largely changes in the engine 11. Therefore, a contribution rate of the model 4 in which the generation amount is measured more finely as the EGR and the SOI become larger is highest, and thus the prediction accuracy of the model 4 is highest. By finely measuring a region having a large change, the prediction accuracy of the model can be increased.

Process Flow

Figure 15:
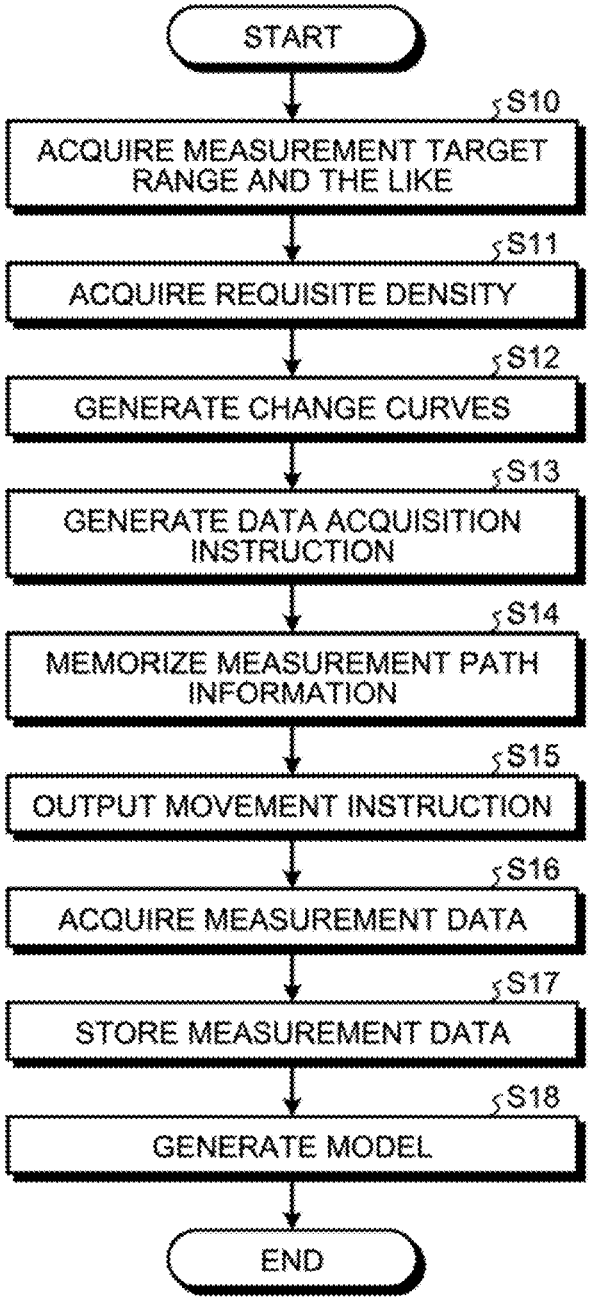
FIG. 15 is a flowchart illustrating an example of procedures of a data-acquisition-instruction generating process.

There is described a flow of a data-acquisition-instruction generating process for generating a data acquisition instruction when the data-acquisition-instruction generating device 10 according to the present embodiment performs measurement of the engine 11. FIG. 15 is a flowchart illustrating an example of procedures of the data-acquisition-instruction generating process. The data-acquisition-instruction generating process is performed at a predetermined timing, for example, at a timing when an input of an operation instruction that instructs generation start of a model is received from the operation screen.

As illustrated in FIG. 15, the acquiring unit 40 displays the operation screen related to control design on the display unit 22, and acquires a measurement target range, a change rate, and a dead time of a control parameter for each of the control parameters for controlling the engine 11 from the operation screen (S10). The acquiring unit 40 acquires requisite density information related to the requisite density of measurement data from the operation screen (S11).

The first generating unit 41 generates a plurality of change curves related to each of the control parameters based on the requisite density information (S12).

The second generating unit 42 generates a data acquisition instruction to be performed in an order in which change of each control parameter becomes change corresponding to the change curves, and new measurement is performed such that only one of the control parameters changes from the previous measurement (S13). For example, the second generating unit 42 normalizes the measurement target range of each of the control parameters, and arranges the Hilbert curve in the normalized space. The second generating unit 42 uses a change curve generated for each of the control parameters, to convert the Hilbert curve arranged in the normalized space into the measurement path curve in the space of the measurement target range. The second generating unit 42 generates the measurement condition along the measurement path curve. The second generating unit 42 memorizes the measurement condition generated along the measurement path curve in the measurement path information 30, associated with the order along the measurement path curve (S14).

The output unit 43 outputs a movement instruction for operating the engine 11 under the measurement condition along the order of sequence of the measurement conditions memorized in the measurement path information 30 (S15). The storage unit 44 acquires the measurement data (S16). The storage unit 44 stores the acquired measurement data in the measurement data 31, associated with the measurement conditions (S17). For example, the storage unit 44 stores the acquired measurement data in the measurement data 31, associated with the measurement condition of the changing control parameter the dead time earlier. When the control parameter that changes under the measurement condition has been changed, the storage unit 44 discards the measurement data for the period of dead time after the control parameter has been changed.

The third generating unit 45 generates a model by performing machine learning by using the measurement condition memorized in the measurement data 31 and the measurement data corresponding to the measurement condition for each type of the measurement data (S18), and finishes the process.

Effect

As described above, in measurement of the engine 11 having a plurality of control parameters, the data-acquisition-instruction generating device 10 according to the present embodiment acquires requisite density information related to a requisite density of measurement data in a region specified by a combination of control parameters. The data-acquisition-instruction generating device 10 generates a plurality of change curves related to each of the control parameters based on the requisite density information. The data-acquisition-instruction generating device 10 generates a data acquisition instruction to be performed in an order in which change of each control parameter becomes change corresponding to a plurality of change curves, and new measurement is performed such that only one of the control parameters changes from the previous measurement. Accordingly, the data-acquisition-instruction generating device 10 can generate a movement instruction by means of quasi-steady measurement, associated with the requisite density.

The data-acquisition-instruction generating device 10 according to the present embodiment designates the requisite density information as a weight value for each region of the measurement target range of each of the control parameters. The data-acquisition-instruction generating device 10 obtains the weight value for each range obtained by segmentalizing the measurement target range of each of the control parameters at a point to be a boundary of regions based on the requisite density information. The data-acquisition-instruction generating device 10 generates a change curve by connecting the respective segmentalized ranges by a line segment having a smaller inclination as the weight value of the range becomes larger. Accordingly, even if a weight value for each range of the measurement target range of each of the control parameters is specified as the requisite density information, the data-acquisition-instruction generating device 10 can generate a movement instruction by means of quasi-steady measurement with a density corresponding to the weight value for each range of the measurement target range.

Furthermore, the data-acquisition-instruction generating device 10 designates the requisite density information as a function representing a weight corresponding to the control parameter value for the measurement target range of each of the control parameters. The data-acquisition-instruction generating device 10 obtains a conversion function that normalizes change of the function in the measurement target range of each of the control parameters to generate a change curve by converting an inverse function of the conversion function into the measurement target range base on the requisite density information. Accordingly, even if a function representing a weight corresponding to the control parameter value for the measurement target range is specified as the requisite density information, the data-acquisition-instruction generating device 10 can generate a movement instruction by means of quasi-steady measurement with a density corresponding to the weight value represented by the function.

The data-acquisition-instruction generating device 10 according to the present embodiment generates a data acquisition instruction to be performed in an order along the measurement path curve obtained by converting the Hilbert curve arranged in the normalized space into a measurement target range based on a plurality of change curves. Accordingly, the data-acquisition-instruction generating device 10 can generate a measurement condition that comprehensively changes in the space by the measurement target range of each of the control parameters.

Second Embodiment

While the embodiments of the disclosed units have been described heretofore, the disclosed techniques can be carried out in variously different modes other than those described above. In connection to this, other embodiments of the present invention will be described below.

For example, in the embodiment described above, a case where a target device to be measured is assumed as the engine 11 has been described. However, the present invention is not limited thereto. For example, a target device to be measured can be any device, so long as it takes time until the state is stabilized to a steady state after the measurement condition has been changed. For example, the target device to be measured can be an actuator, a plant in which various kinds of production are performed, or large machinery.

In the embodiment described above, a case where a model is generated for each type of measurement data has been described. However, the present invention is not limited thereto. For example, a model that predicts a plurality of types of measurement data by performing machine learning can be generated by using measurement conditions memorized in the measurement data 31 and measurement data in a steady state corresponding to the measurement condition. For example, the third generating unit 45 can generate one model that predicts all types of measurement data.

Respective constituent elements of the devices illustrated in the drawings are functionally conceptual, and physically the same configuration is not always necessary. That is, the specific mode of distribution and integration of the respective devices is not limited to the ones illustrated in the drawings, and all or a part thereof can be functionally or physically distributed or integrated in an optional unit according to various kinds of load and status of use. For example, respective processing units of the acquiring unit 40, the first generating unit 41, the second generating unit 42, the output unit 43, the storage unit 44, and the third generating unit 45 can be integrated appropriately. Further, all or an optional part of various processing functions performed by each processing unit can be realized by a CPU or a program analyzed and executed by the CPU, or can be realized as hardware by a wired logic.

Data-Acquisition-Instruction Generating Program

Figure 16:
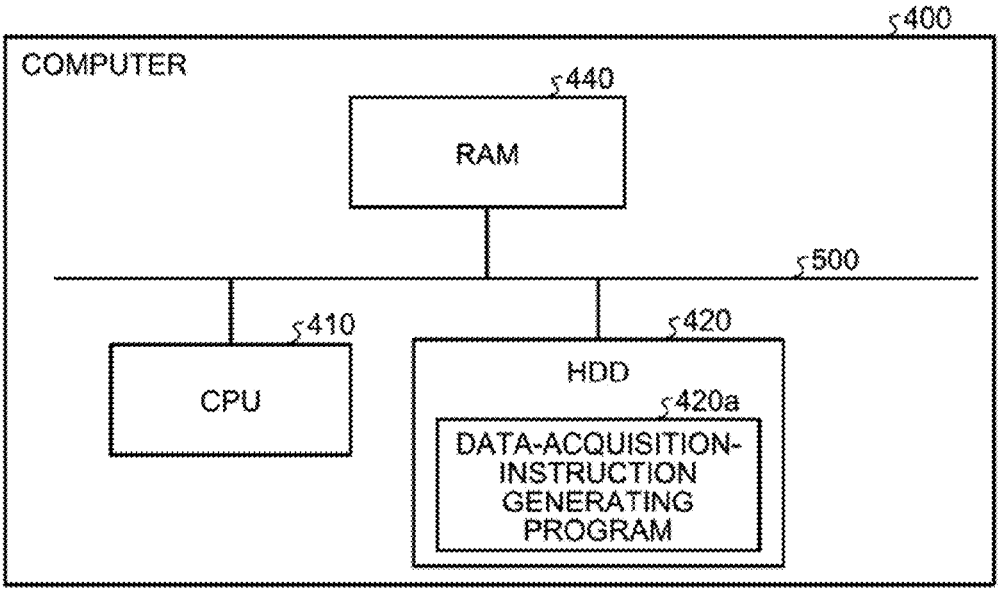
FIG. 16 is an explanatory diagram illustrating an example of a configuration of a computer that executes a data-acquisition-instruction generating program.

The various types of processing described in the above embodiment can be realized by executing a program prepared beforehand by a computer system such as a personal computer or a workstation. Therefore, an example of a computer system that executes a program having the same functions as those of the embodiment described above is described below. First, a data-acquisition-instruction generating program that executes control calling for attention with respect to a driver is described. FIG. 16 is an explanatory diagram illustrating an example of a configuration of a computer that executes a data-acquisition-instruction generating program.

As illustrated in FIG. 16, a computer 400 includes a CPU (Central Processing Unit) 410, an HDD (Hard Disk Drive) 420, and a RAM (Random Access Memory) 440. These respective units 400 to 440 are connected to each other via a bus 500.

A data-acquisition-instruction generating program 420*a* that demonstrates the same functions as those of the acquiring unit 40, the first generating unit 41, the second generating unit 42, the output unit 43, the storage unit 44, and the third generating unit 45 is memorized beforehand in the HDD 420. The data-acquisition-instruction generating program 420*a* can be appropriately separated.

The HDD 420 memorizes various types of information. For example, the HDD 420 memorizes various types of data to be used for determination of an OS and an order quantity.

The CPU 410 performs the same operations as those of the respective processing units in the embodiment by reading out the data-acquisition-instruction generating program 420*a* from the HDD 420 and executing the data-acquisition-instruction generating program 420*a*. That is, the data-acquisition-instruction generating program 420*a* performs the same operations as those of the acquiring unit 40, the first generating unit 41, the second generating unit 42, the output unit 43, the storage unit 44, and the third generating unit 45.

The data-acquisition-instruction generating program 420*a* described above is not necessarily stored in the HDD 420 from the beginning.

For example, the data-acquisition-instruction generating program 420*a* can be stored in a "portable physical medium" such as a flexible disk (FD), a CD-ROM, a DVD disk, a magneto-optical disk, and an IC card inserted into the computer 400. The computer 400 can read and execute these programs from such a medium.

Further, programs can be stored in "other computers (or servers)" connected to the computer 400 via a public line, the Internet, a LAN, or a WAN. The computer 400 can read and execute these programs from such a medium.

According to one aspect of the present invention, a movement instruction by quasi-steady measurement can be generated corresponding to a requisite density.

All examples and conditional language recited herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A non-transitory computer-readable recording medium storing a data-acquisition-instruction generating program that causes a computer to execute a process comprising:

accepting, via an input unit from a user, information of requisite density wherein a combination of a plurality of control parameters is used for operating a device on which data is measured, a measurement target region includes data that is to be measured by changing each of the control parameters, and the requisite density is a required density of measured data in the measurement target region;

first generating a plurality of change curves for the combination of control parameters that represents the requisite density;

second generating a data acquisition instruction to measure data by operating the device by changing the combination of control parameters according to the generated change curves in an order in which one control parameter among the control parameters is changed and then another control parameter among the control parameters is changed; and third generating a model that predicts measured data on the device when changing the control parameters, based on measured data that are acquired according to the data acquisition instruction.

2. The non-transitory computer-readable recording medium according to claim 1, wherein the information of requisite density includes a first weight value for each of regions that are divided regions in the measurement target region, and the first generating includes obtaining a second weight value for each of ranges that are obtained by segmentalizing divided region according to a line of the divided regions, based on the information of requisite density, and generating change curves by connecting the respective segmentalized ranges by a line segment having a smaller inclination, as the second weight value of a range becomes larger.

3. The non-transitory computer-readable recording medium according to claim 1, wherein the information of requisite density includes a function representing a weight according to a value of a control parameter among the control parameters for the measurement target region, and the first generating includes obtaining a conversion function that normalizes change of the function in the measurement target region based on the requisite density information, and generating change curves by converting an inverse function of the conversion function into the measurement target region.

4. The non-transitory computer-readable recording medium according to claim 1, wherein the second generating includes generating a data acquisition instruction to measure the data in an order along a measurement path curve obtained by converting a Hilbert curve arranged in a normalized space, in which the measurement target region is normalized, into the measurement target region based on the change curves.

5. A data-acquisition-instruction generating method comprising:

accepting, via an input unit from a user, information of requisite density wherein a combination of a plurality of control parameters is used for operating a device on which data is measured, a measurement target region includes data that is to be measured by changing each of the control parameters and the requisite density is a required density of measured data in the measurement target region, by a processor;

first generating a plurality of change curves for the combination of control parameters that represents the requisite density, by the processor;

second generating a data acquisition instruction to measure data by operating the device by changing the combination of control parameters according to the generated change curves in an order in which one control parameter among the control parameters is changed and then another control parameter among the control parameters is changed, by the processor; and third generating a model that predicts measured data on the device when changing the control parameters, based on measured data that are acquired according to the data acquisition instruction, by the processor.

6. A data-acquisition-instruction generating device comprising:

a processor configured to:

accept, via an input unit from a user, information of requisite density wherein a combination of a plurality of control parameters is used for operating a device on which data is measured, a measurement target region includes data that is to be measured by changing each of the control parameters and the requisite density is a required density of measured data in the measurement target region;

generate a plurality of change curves for the combination of control parameters that represents the requisite density;

generate a data acquisition instruction to measure data by operating the device by changing the combination of control parameters according to the generated change curves in an order in which one control parameter among the control parameters is changed and then another control parameter among the control parameters is changed; and generate a model that predicts measured data on the device when changing the control parameters, based on measured data that are acquired according to the data acquisition instruction.

* * * * *